US008899716B2

(12) United States Patent
Takagi et al.

(10) Patent No.: US 8,899,716 B2
(45) Date of Patent: Dec. 2, 2014

(54) INK CARTRIDGE

(71) Applicants: Yuki Takagi, Nagoya (JP); Tomohiro Kanbe, Nagoya (JP); Hirotake Nakamura, Nagoya (JP)

(72) Inventors: Yuki Takagi, Nagoya (JP); Tomohiro Kanbe, Nagoya (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 43 days.

(21) Appl. No.: 13/721,994

(22) Filed: Dec. 20, 2012

(65) Prior Publication Data

US 2013/0162732 A1 Jun. 27, 2013

(30) Foreign Application Priority Data

Dec. 22, 2011 (JP) ..... 2011-282168

(51) Int. Cl.
*B41J 29/393* (2006.01)
*B41J 2/175* (2006.01)

(52) U.S. Cl.
CPC .... *B41J 2/17503* (2013.01); *B41J 2002/17573* (2013.01); *B41J 2002/17576* (2013.01)
USPC ..... 347/19; 347/7; 347/86

(58) Field of Classification Search
None
See application file for complete search history.

(56) References Cited

U.S. PATENT DOCUMENTS

2007/0295408 A1* 12/2007 Han ..... 137/429
2011/0234717 A1* 9/2011 Sakurai ..... 347/86

FOREIGN PATENT DOCUMENTS

JP 2007-015393 A 1/2007
JP 2009-132098 A 6/2009

* cited by examiner

*Primary Examiner* — Justin Seo
(74) *Attorney, Agent, or Firm* — Baker Botts L.L.P.

(57) ABSTRACT

An ink cartridge includes an ink chamber, a shaft, and a pivotable member including a float. The pivotable member is configured to move about the shaft between a first position and a second position when the float moves. The float is positioned higher when the pivotable member is in the first position than when the pivotable member is in the second position. The float has a triangular shape when viewed in an axial direction of the shaft, and the triangular shape comprises a first side having a first dimension, a second side having a second dimension, and a third side having a third dimension. The first dimension is greater than each of the second dimension and the third dimension, and the first side is positioned above a vertex between the second side and the third side.

10 Claims, 5 Drawing Sheets

INK CARTRIDGE

CROSS REFERENCE TO RELATED APPLICATION

The present application claims priority to and the benefit of Japanese Application No. JP-2011-282168, which was filed on Dec. 22, 2011, the disclosure of which is incorporated herein by reference in its entirety.

BACKGROUND OF THE INVENTION

1. Field of the Invention

The present invention relates to an ink cartridge comprising a pivotable member positioned in an ink chamber.

2. Description of Related Art

A known image recording apparatus, as described in Patent Application Publication No. JP-A-2009-132098, adopts a tube-supply system, in which an ink cartridge is positioned outside a carriage carrying a recording head, and the ink cartridge and the recording head are fluidically connected to each other via a flexible tube. The ink cartridge is configured to be mounted to a cartridge mounting portion in a horizontal direction via an opening formed at the front of the recording apparatus. The cartridge mounting portion is configured to removably receive the ink cartridge therein. When the ink cartridge is mounted to the cartridge mounting portion, a path through which ink flows is formed between the ink cartridge and the recording head. Ink is supplied from the ink cartridge to the recording head via the path.

Another known image recording apparatus, as described in Patent Application Publication No. JP-A-2007-15393, has an ink cartridge having an detection portion and a cartridge mounting portion having a sensor configured to detect the detection portion for an amount of ink stored in the ink cartridge to be determined by the image recording apparatus. For example, the ink cartridge has a pivotable member positioned in an ink chamber of the ink cartridge, and the pivotable member is configured to move based on an amount of ink stored in the ink chamber. The pivotable member has the detection portion positioned in a detection chamber which is in fluid communication with the ink chamber. By the detecting the position of the detection portion, it is possible to determine whether the ink amount in the ink chamber becomes less than a predetermined amount.

During mounting of the above-described cartridge to the cartridge mounting portion, acceleration in the direction of mounting is applied to the ink cartridge and/or the ink cartridge moves up and down due to a clearance between the ink cartridge and the cartridge mounting portion. That may cause bubbles to be formed in the ink chamber and/or a film of ink may be formed between the detection portion and a wall surface of the detection chamber surrounding the detection portion. The bubbles and/or the film of ink may hinder the movement of the pivotable member and the pivotable member may not move even when the ink amount in the ink chamber becomes less than the predetermined amount. In such a case, it is wrongly determined that the ink amount is still greater than or equal to the predetermined amount although the actual ink amount is less than the predetermined amount.

SUMMARY OF THE INVENTION

Therefore, a need has arisen for an ink cartridge, which overcomes these and other shortcomings of the related art. A technical advantage of the present invention is that a pivotable member moves smoothly based on an amount of ink stored in an ink chamber.

According to an embodiment of the present invention, an ink cartridge comprises an ink chamber configured to store ink therein, a shaft positioned in the ink chamber, and pivotable member comprising a float. The float is configured to move based on an amount of ink stored in the ink chamber, and the pivotable member is configured to move about the shaft between a first position and a second position when the float moves. The float is positioned higher when the pivotable member is in the first position than when the pivotable member is in the second position. The float has a triangular shape when viewed in an axial direction of the shaft, and the triangular shape comprises a first side having a first dimension, a second side having a second dimension, and a third side having a third dimension. The first dimension is greater than each of the second dimension and the third dimension, and the first side is positioned above a vertex between the second side and the third side when the pivotable member is in the first position.

Objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof reference now is made to the following description taken in connection with the accompanying drawings.

DETAILED DESCRIPTION OF EMBODIMENTS OF THE INVENTION

Embodiments of the present invention, and their features and advantages, may be understood by referring to FIGS. 1-5, like numerals being used for like corresponding parts in the various drawings.

[Printer 10]

Figure 1:
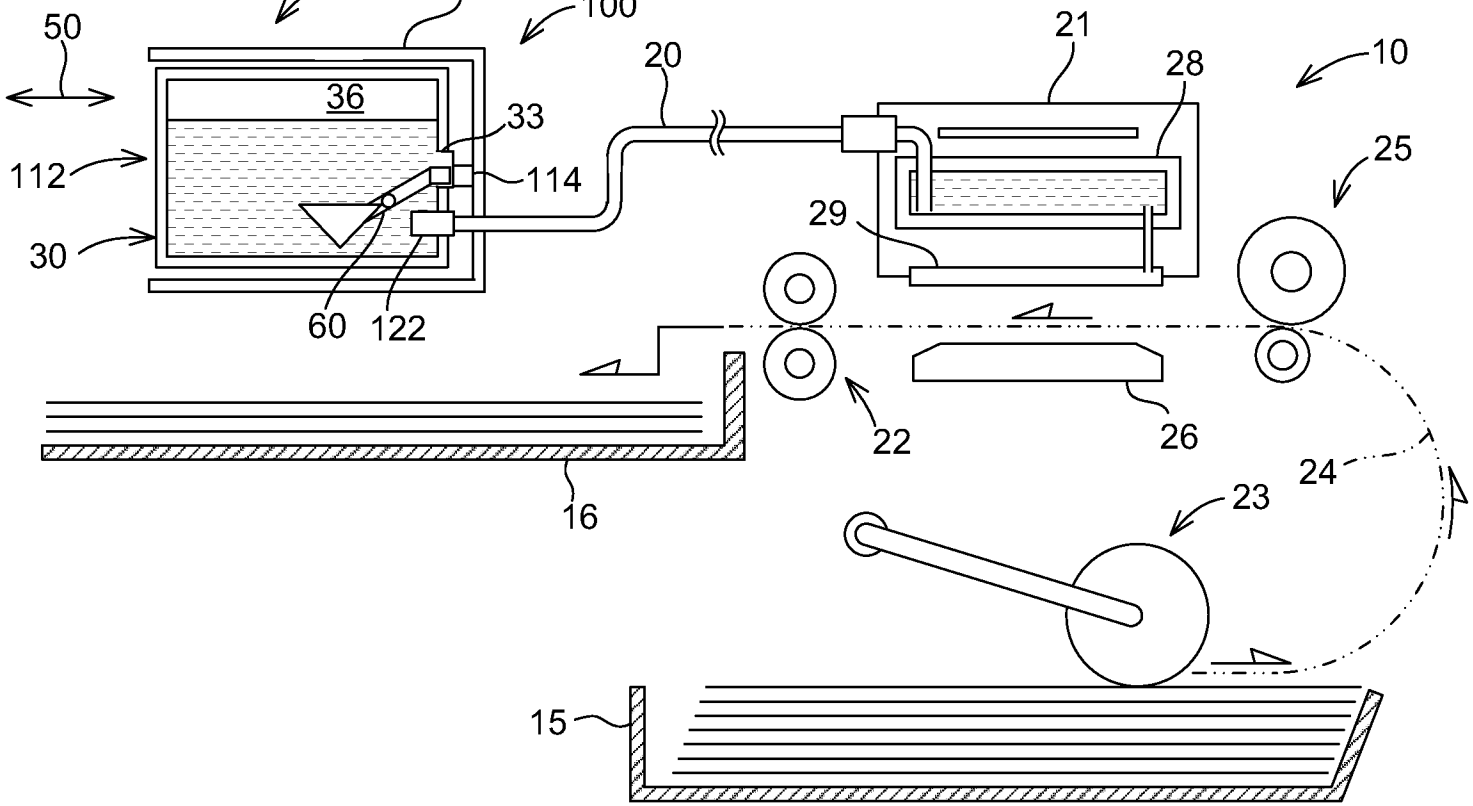
FIG. 1 is a schematic, cross-sectional view of a printer comprising a cartridge mounting portion and an ink cartridge, according to an embodiment of the present invention.

Referring to FIG. 1, an image recording apparatus, e.g., a printer 10, is an inkjet printer configured to record an image on a sheet of paper by ejecting ink droplets selectively on the sheet of paper. The printer 10 comprises an ink supply device 100. The ink supply device 100 comprises a cartridge mounting portion 110. The cartridge mounting portion 110 is configured to allow a printing fluid cartridge, e.g., an ink cartridge 30, to be mounted therein. The cartridge mounting portion 110 has an opening 112 and the interior of the cartridge mounting portion 110 is exposed to the exterior of the cartridge mounting portion 110 via opening 112. The ink cartridge 30 is configured to be inserted into the cartridge mounting portion 110 via the opening 112, such that the ink cartridge 30 is mounted to the cartridge mounting portion 110. The ink cartridge 30 is configured to be removed from the cartridge mounting portion 110 via the opening 112.

The ink cartridge 30 is configured to store ink, which is used by printer 10. The printer 10 comprises a recording head 21 and a flexible ink tube 20. The ink cartridge 30 and the recording head 21 are fluidically connected via the ink tube 20 when the ink cartridge 30 is mounted to the cartridge mounting portion 110. The recording head 21 comprises a sub tank 28. The sub tank 28 is configured to temporarily store ink supplied via the ink tube 20 from the ink cartridge 30. The recording head 21 comprises nozzles 29 and is configured to selectively eject ink supplied from the sub tank 28 through the nozzles 29.

The printer 10 comprises a paper feed tray 15, a paper feed roller 23, a conveying roller pair 25, a platen 26, a discharge roller pair 22, and a discharge tray 16. A conveying path 24 is formed from the paper feed tray 15 up to the discharge tray 16 via the conveying roller pair 25, the platen 26, and the discharge roller pair 22. The paper feed roller 23 is configured to feed a sheet of paper from the paper feed tray 15 to the conveying path 24. The conveying roller pair 25 is configured to convey the sheet of paper fed from the paper feed tray 15 onto the platen 26. The recording head 21 is configured to selectively eject ink onto the sheet of paper passing over the platen 26. Accordingly, an image is printed on the sheet of paper. The sheet of paper having passed over the platen 26 is discharged by the discharge roller pair 22 to the paper discharge tray 16 disposed at the most downstream side of the conveying path 24.

[Cartridge Mounting Portion 110]

The cartridge mounting portion 110 comprises a case 101, and the case 101 has the opening 112 formed through one face of the case 101. The ink cartridge 30 is configured to be inserted into or removed from the case 101 through the opening 112 in an insertion/removal direction 50.

The case 101 comprises an end surface opposite the opening 112 in the insertion/removal direction 50. The cartridge mounting portion 110 comprises an ink pipe 122 provided at a lower portion of the end surface of the case 101. The ink pipe 122 is a cylindrical pipe made of a synthetic resin. The ink pipe 122 is connected to the flexible ink tube 20 at the exterior of the case 101. The ink tube 20 connected to the ink pipe 20 extends to the recording head 21 to supply ink to the printing head 21.

When the ink cartridge 30 is mounted to the cartridge mounting portion 110, the ink pipe 122 is inserted into an ink supply opening 35 of an ink supply portion 34 of the ink cartridge 30. When this occurs, ink flows out of an ink chamber 36 of the ink cartridge 30 to an exterior of the ink cartridge 30, i.e., flows into the ink pipe 20.

The cartridge mounting portion 110 comprises an optical sensor 114 provided at the end surface of the case 101 above the ink pipe 122. The optical sensor 114 comprises a light emitting device, e.g., a light emitting diode, and a light receiving device, e.g., a photo-transistor. The optical sensor 114 has substantially a U-shape casing, two prongs thereof extends away from the end surface of the case 101 toward the opening 112. The light emitting device is positioned in the end portion of one of the prongs and the light receiving device is positioned in the end portion of the other of the prongs. The light emitting device and the light receiving device are aligned in a horizontal direction (width direction 51) perpendicular to the insertion/removal direction 50 with a gap formed therebetween. The light emitting device is configured to emit light, e.g., visible or infrared light, in the width direction 51 toward the light receiving device, and the light receiving device is configured to receive light emitted from the light emitting device. detection chamber 33 is positioned between the light emitting device and the light receiving device, when the ink cartridge 30 is mounted to the cartridge mounting portion 110.

The cartridge mounting portion 110 comprises a lock mechanism (not shown) configured to retain the ink cartridge 30 in a mounted position in the cartridge mounting portion 110.

[Ink Cartridge 30]

Figure 2:
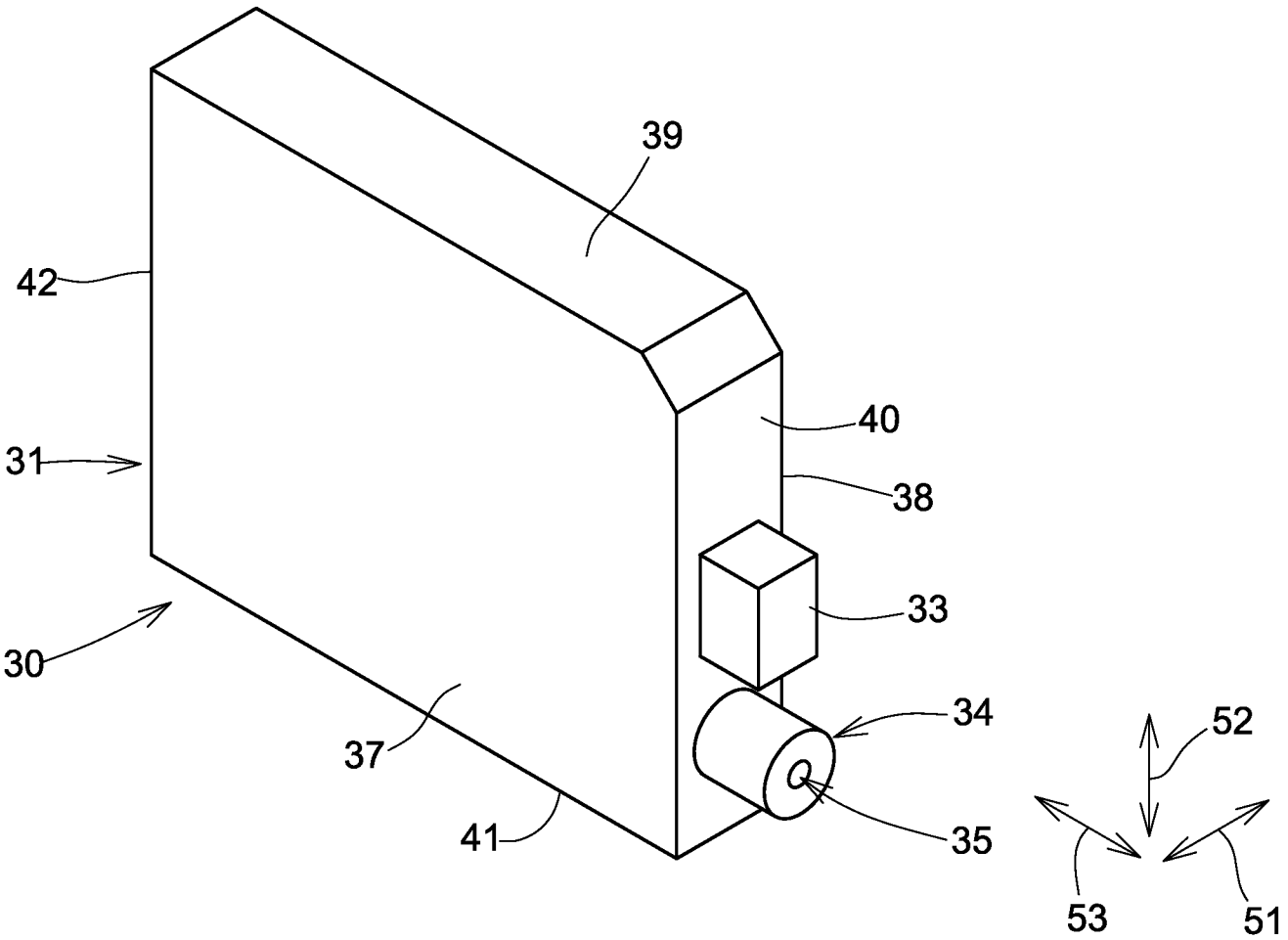
FIG. 2 is a perspective view of the ink cartridge.

The ink cartridge 30 is configured to be inserted into and removed from the cartridge mounting portion 110 in the insertion/removal direction 50, while the ink cartridge 30 is in an upright position, as shown in FIG. 2, with a top face of the ink cartridge 30 facing upward and a bottom face of the ink cartridge 30 facing downward. The insertion/removal direction 50 extends in a horizontal direction. The ink cartridge 30 is in the upright position when the ink cartridge 30 is mounted to the cartridge mounting portion 110 in the mounted position. When the ink cartridge 30 is in the upright position, a height direction (up-down direction) 52 corresponds to the gravitational direction (vertical direction). In another embodiment, the insertion/removal direction 50 may not extend exactly in a horizontal direction but may extend in a direction intersecting a horizontal direction and the gravitational direction (vertical direction).

The ink cartridge 30 comprises a main body 31. The ink cartridge 30 comprises the ink chamber 36, which is a space formed in the interior of the main body 31. The main body 31 has a width in the width direction (left-right direction) 51, a height in the height direction (up-down direction) 52, and a depth in a depth direction (front-rear direction) 53. The width direction (left-right direction) 51, the height direction (up-down direction) 52, and the depth direction (front-rear direction) 53 are perpendicular to each other. The width of the main body 31 is less than the height and the depth of the main body 31. When ink cartridge 30 is in the mounted position (upright position), the width direction (left-right direction) 51 is parallel with a horizontal plane, the depth direction (front-rear direction) 53 is also parallel with the horizontal plane, and the height direction (up-down direction) 52 is parallel with the gravitational direction (vertical direction). When the ink cartridge 30 is inserted into/removed from the cartridge mounting portion 110, the depth direction (front-rear direction) 53 is parallel with the insertion/removal direction 50, and the width direction (left-right direction) 51 and the height direction (up-down direction) 52 are perpendicular to the insertion/removal direction 50.

The main body 31 comprises a front wall 40 and a rear wall 42. The front wall 40 is positioned at the front of the ink cartridge 30 in an insertion direction when the ink cartridge 30 is inserted into the cartridge mounting portion 110, and the rear wall 42 is positioned at the rear of the ink cartridge 30 in the insertion direction when the ink cartridge 30 is inserted into the cartridge mounting portion 110. At least a portion of the front wall 41 overlaps at least a portion of the rear wall 42 in the insertion/removal direction 50 (depth direction 53). The main body 31 further comprises a top wall 39, a bottom wall 41, and a pair of side walls 37, 38. The top wall 39 extends between the upper end of the front wall 40 and the upper end of the rear wall 42. The bottom wall 41 extends between the lower end of the front wall 40 and the lower end of the rear wall 42. One of the side walls 37, 38 is connected to one side of the front wall 40, the rear wall 42, the top wall 39, and the bottom wall 41 in the width direction 51, and the other of the side walls 37, 38 is connected to the other side of the front wall 40, the rear wall 42, the top wall 39, and the bottom wall 41 in the width direction 51. The front wall 40, the rear wall 42, the top wall 39, the bottom wall 41, and the side walls 37, 38 form the exterior of the main body 31.

The ink cartridge 30 comprises a protrusion protruding forward in the insertion/removal direction 50 from a middle portion of the front wall 40 with respect to the height direction 52. The protrusion comprises the detection chamber 33 formed therein. The detection chamber 33 is defined by a top wall, a bottom wall, a front wall, and a pair of side walls of the protrusion. The detection chamber 33 is opened to the ink chamber 36 in the insertion/removal direction 50 and is in fluid communication with the ink chamber 36. The pair of side walls defining the detection chamber 33 comprises a translucent material, e.g., transparent or semi-transparent synthetic resin, and is configured to allow light, e.g., visible or infrared light, traveling in a direction perpendicular to the insertion/removal direction 50 to pass therethrough. In this embodiment, the direction perpendicular to the insertion/removal direction 50 is the width direction (left-right direction) 51. When the ink cartridge 30 is mounted to the cartridge mounting portion 110, the optical sensor 114 emits light in the direction perpendicular to the insertion/removal direction 50. The detection chamber 33 may allow the light which is emitted from the optical sensor 114 and reaches the detection chamber 33 to pass therethrough.

Figure 3:
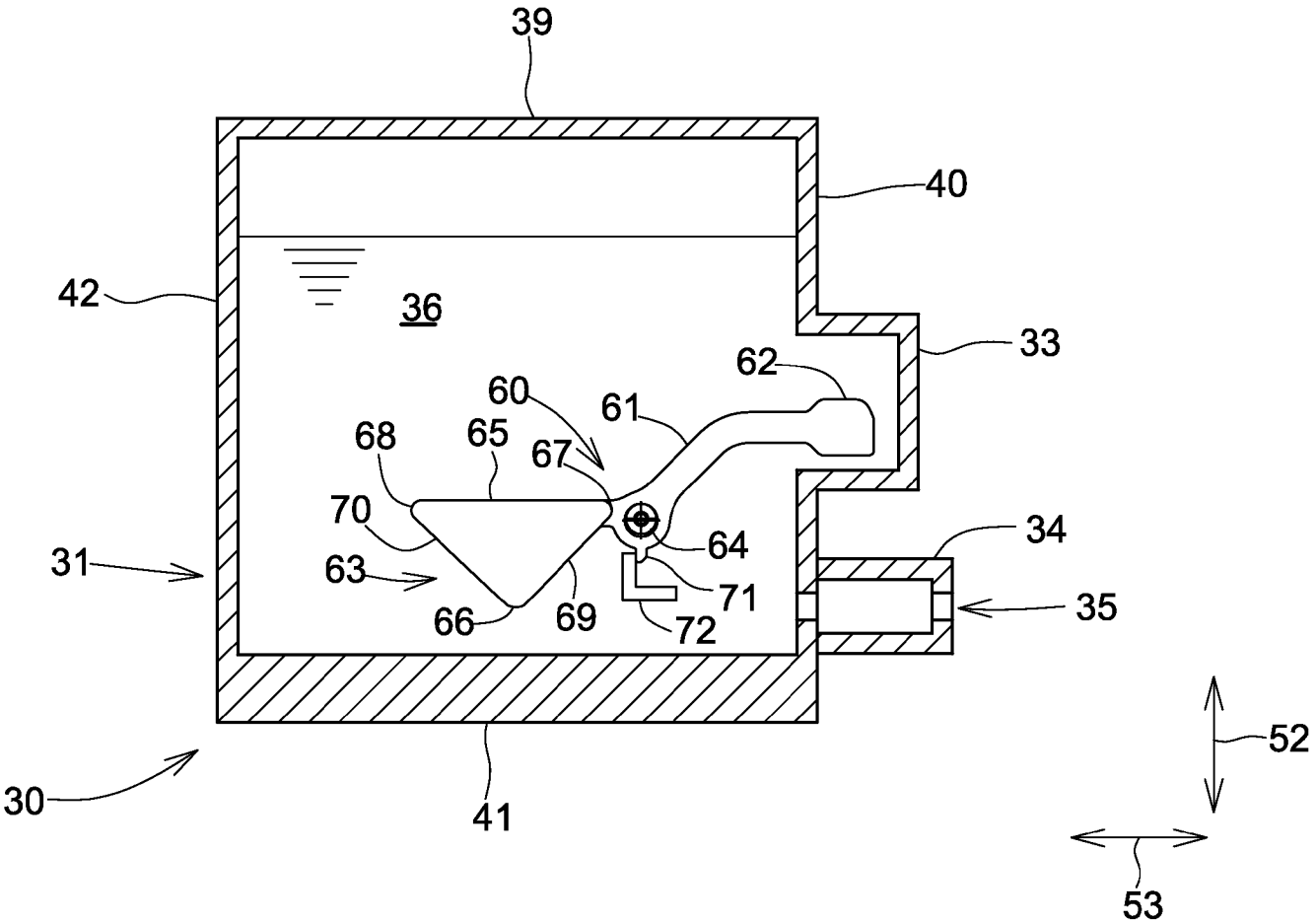
FIG. 3 is a vertical, cross-sectional view of the ink cartridge when there is sufficient amount of ink in an ink chamber.

The pair of side walls defining the detection chamber 33 is aligned in the width direction (left-right direction) 51, and the detection chamber 33 is formed between the pair of side walls defining the detection chamber 33. Ink stored in the ink chamber 36 can reach the detection chamber 33. The ink cartridge 30 comprises a pivotable member 60 positioned in the ink chamber 36. The pivotable member 60 comprises an arm body 61 extending mainly in the depth direction (front-rear direction) 53, a detection portion 62 positioned at one end of the arm body 61 with respect to the depth direction (front-rear direction) 53, and a float 63 positioned at the other end of the arm body 61 with respect to the depth direction (front-rear direction) 53. The detection portion 62 is positioned in the detection chamber 33 between the pair of side walls of defining the detection chamber 33. The ink cartridge 30 comprises a support shaft 64 positioned in the ink chamber 36, and the support shaft 64 extends in the width direction (left-right direction) 51. The both ends of the support shaft 64 are supported at inner wall surfaces of the side walls 37, 38. The pivotable member 60 has an opening formed therethrough in the width direction 51, and the support shaft 64 is inserted through the opening of the pivotable member 64. The pivotable member 60 is supported by the support shaft 64, such that the pivotable member 60 can pivot about the support shaft 64. The pivotable member 60 is configured to pivot based on the amount of ink stored in the ink chamber 36. More specifically, the float 63 is configured to move based on the amount of ink stored in the ink chamber, and the pivotable member 60 is configured to move about the support shaft 64 between a first position and a second position when the float 63 moves. The float 63 is positioned higher when the pivotable member 60 is in the first position than when the pivotable member 60 is in the second position. When the pivotable member 60 is in the first position, the detection portion 62 is positioned in a lower portion of the detection chamber 33 with respect to the gravitational direction (vertical direction). When the pivotable member 60 is in the second position, the detection portion 62 is positioned in an upper portion of the detection chamber 33 with respect to the gravitational direction. The detection portion 62 is positioned higher when the pivotable member 60 is in the second position than when the pivotable member 60 is in the first position. FIG. 3 depicts the pivotable member 60 positioned in the first position when the ink chamber 36 has a predetermined amount or more of ink stored therein. When the pivotable member 60 is in the first position, a portion of the arm body 61 extends obliquely upward from the support shaft 64 and then extends horizontally to be connected to the detection portion 62. When the pivotable member 60 is in the first position, the detection portion 62 is positioned higher than the float 63.

When the ink cartridge 30 is mounted in the cartridge mounting portion 110, the detection chamber 33 is positioned between the light emitting device and the light receiving device of the optical sensor 114, which are aligned in the width direction (left-right direction) 51 perpendicular to the insertion/removal direction 50, and the detection chamber 33 is configured to change its state between a first state and a second state. When the detection chamber 33 is in the first state, the detection chamber 33 allows light, which is emitted from the light emitting device of the optical sensor 114 and travels in the direction (the width direction or left-right direction 51) perpendicular to the insertion/removal direction 50, to pass therethrough. When the detection chamber 33 is in the second state, the detection portion 33 attenuates the light. More specifically, when the detection chamber 33 is in the first state and the light reaches one of the pair of side walls defining the detection chamber 33 in the direction (width direction or left-right direction 51) perpendicular to the insertion/removal direction 50, a predetermined amount or more of the light comes out of the other one of the pair of side walls defining the detection chamber 33 in the direction the width direction or left-right direction 51) perpendicular to the insertion/removal direction 50 and reaches the light receiving device of the optical sensor 114. When the detection chamber 33 is in the second state and the light reaches one of the pair of side walls defining the detection chamber 33 in the direction (the width direction or left-right direction 51) perpendicular to the insertion/removal direction 50, the amount of light coming out of the other one of the pair of side walls defining the detection portion 33 and reaching the light receiving device of the optical sensor 114 is less than the predetermined amount, e.g., zero. When the pivotable member 60 is in the second position, the detection chamber 33 is in the first state to allow the light to pass therethrough. When the pivotable member 60 is in the in the first position, the detection chamber 33 is in the second state to attenuate the light. The attenuation of the light is caused by the detection portion 62 completely preventing the light from passing therethrough in the direction (the width direction or left-right direction 51) perpendicular to the insertion/removal direction 50, by the detection portion 62 absorbing some amount of the light, by the detection portion 62 deflecting the light, by the detection portion 62 totally reflecting the light, and etc. As such, the amount (intensity) of the light reaching the light receiving device of the optical sensor 114 depends on the state of the detection chamber 33, i.e., depends on the position of the detection portion 62. By detecting the state of the detection chamber 33 with the optical sensor 114, i.e., by detecting the detection portion 62 with the optical sensor 114, it is determined whether the ink chamber 36 has the predetermined amount or more of ink stored therein.

In another embodiment, instead of the detection by the optical sensor 114, a user can detect the state of the detection chamber 33, i.e., a user can detect the position of the detection portion 62 in the detection chamber 33, to determine whether the ink chamber 36 has the predetermined amount or more of ink stored therein.

The float 63 extends from the support shaft 64 away from the detection portion 62. The support shaft 64 is positioned between the detection portion 62 and the float 63 with respect to the depth direction 53 and the insertion/removal direction 50. The float 63 has a triangular pole shape, and the triangular base of the triangular pole is perpendicular to the width direction 51. Therefore, the float 63 has a triangular shape when viewed in an axial direction of the support shaft 64, i.e., in the width direction 51. The triangular shape comprises a first side 65 having a first dimension, a second side 69 having a second dimension, and a third side 70 having a third dimension. The first dimension is greater than each of the second dimension and the third dimension. The second dimension is equal to the third dimension. Each of the first side 65, the second side 69, and the third side 70 extends straight. When the pivotable member 60 is in the first position, the first side 65 is positioned above a vertex 66 between the second side 69 and the third side 70. The vertex 66 between the second side 69 and the third side 70 is rounded, a vertex 67 between the first side 65 and the second side 69 is rounded, and a vertex 68 between the first side 65 and the third side 70 is rounded. The second side 69 and the third side 70 form a right angle therebetween. The vertex 67 between the first side 65 and the second side 69 is positioned adjacent to the support shaft 64 and positioned at substantially the same height as the support shaft 64. The float 63 has a width dimension in the width direction 51, which is greater than a dimension of the arm body 61 and a dimension of the detection portion 62 in the width direction 51. The cross sectional shape of the float 63 on a plane perpendicular to the width direction 51 is the same at any portion of the float 63 along the width direction 51. The float 63 is configured to float on ink stored in the ink chamber 63. In other words, when the float 63 is submerged in ink, the buoyancy acting on the float 63 is greater than the gravity acting on the float 63. The float 63 may comprise a hollow space formed therein. Alternatively, the float 63 may comprise a material whose specific gravity is less than the specific gravity of ink stored in the ink chamber 63.

The ink cartridge 30 comprises a first contact portion, e.g., a rib 72 positioned in the ink chamber 36, and the rib 72 is positioned below the pivotable member 60 and extends upward toward the pivotable member 60. The arm body 61 comprises a second contact portion, e.g., a stopper 71 extending downward from a portion adjacent to the support shaft 64. The stopper 71 is configured to contact the rib 72. The contact between the stopper 71 and the rib 72 prevents the pivotable member 60 from pivoting beyond the first position in a direction that the float 63 moves upward. When the pivotable member 60 stays in the first position by the contact between the stopper 71 and the rib 72, the first side 65 extends in parallel with a surface of ink stored in the ink chamber 36, i.e., extends in a horizontal direction. In other words, when the pivotable member 60 stays in the first position by the contact between the stopper 71 and the rib 72, the first side 65 extends in a first direction intersecting the gravitational direction, the second side 69 extends in a second direction intersecting the gravitational direction, and the third side 70 extends in a third direction intersecting the gravitational direction.

The ink cartridge 30 comprises the ink supply portion 34 at the front wall 40 below the detection chamber 33. The ink supply portion 34 has a cylindrical shape and extends from the front wall 40 forward in the insertion/removal direction 50 and in the depth direction 63. The ink supply portion 34 has an ink path formed therein. The ink path extends from the ink chamber 36 up to the ink supply opening 35 formed at the front end of the ink supply portion 34. The ink supply opening 35 is positioned below the first side 65 of the float 63. The ink cartridge 30 comprises an ink supply valve configured to selectively open and close the ink supply opening 35. When the ink cartridge 30 is mounted to the cartridge mounting portion 110, the ink pipe 122 provided in the cartridge mounting portion 110 is inserted through the ink supply opening 35 and pushes the ink supply valve, such that the ink supply opening 35 is opened. When this occurs, ink is flowed out of the ink chamber 36 into the ink pipe 122 via the ink path of the ink supply portion 34. In another embodiment, the ink cartridge 30 may not comprise the ink supply valve. In such a case, the ink supply opening 35 may be covered and closed by a film. When the ink cartridge 30 is mounted to the cartridge mounting portion 110, the ink pipe 122 may break through the film, such that the ink supply opening 35 is opened.

Referring to FIG. 3, when the ink cartridge 30 is mounted in the cartridge mounting portion 110 and the ink chamber 36 has a sufficient amount of ink stored therein, the buoyancy acting on the float 63 is greater than the gravity acting on the float 63. Therefore, the float 63 is caused to move upward. Nevertheless, the contact between the stopper 71 and the rib 72 retains the pivotable member 60 in the first position, such that further upward movement of float 63 is prevented. When the pivotable member 60 is in the first position, the first side 65 of the float 63 extends in parallel with a surface of ink stored in the ink chamber 36, i.e., extends in a horizontal direction.

Figure 4:
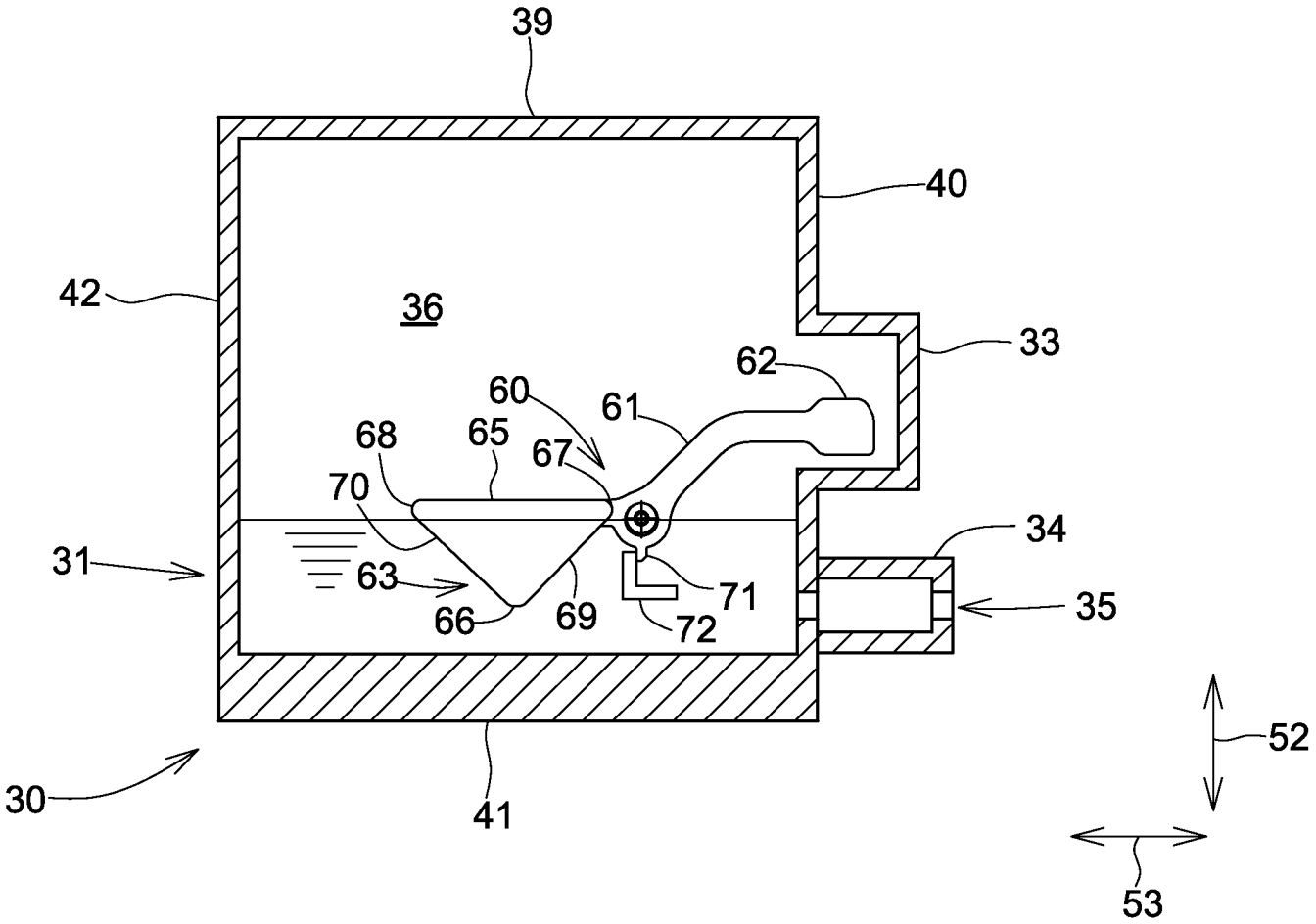
FIG. 4 is a vertical, cross-sectional view of the ink cartridge when the amount of ink in the ink chamber is reduced.
Figure 5:
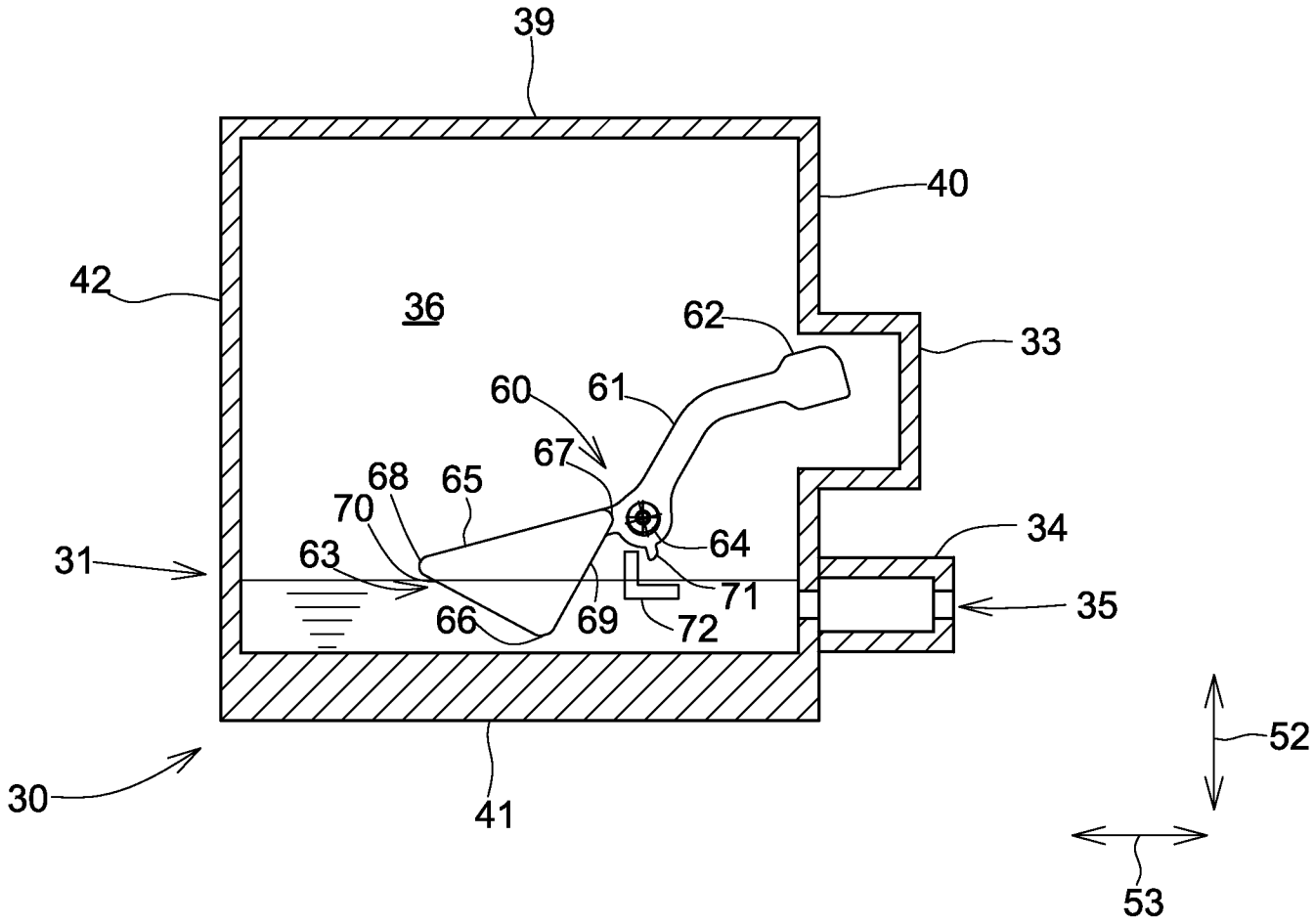
FIG. 5 is a vertical, cross-sectional view of the ink cartridge when the amount of ink in the ink chamber is further reduced, such that a pivotable member moves.

Referring to FIG. 4, when ink flows out of the ink chamber 36 to the exterior of the ink cartridge 30 via the ink pipe 122 and the surface of ink stored ink the ink chamber 36 lowers, an upper portion of the float 63 having the first side 65 comes out of the surface of ink and is exposed to the air in the ink chamber 36. When this occurs, the buoyancy acting on the float 63 becomes small. When the surface of ink further lowers, the buoyance becomes further smaller, and the buoyancy and the gravity acting on the float 63 balance each other out. Referring to FIG. 5, when the surface of ink further lowers, the float 63 moves downward, following the surface of the ink, and the pivotable member 60 moves to the second position.

As described above, the buoyancy acting on the float 63 decreases as the surface of ink lowers. Because the first side 65 having the maximum dimension is positioned highest in the float 63, the decrease rate of the buoyancy acting on the float 63 is the biggest when the first side 65 of the float 63 first comes out of the surface of ink compared to when a portion of the float 63 below the first side 65 comes out of the surface of ink. Moreover, because the dimension of the float 63 in the depth direction 53 or in the insertion/removal 50 becomes smaller toward the vertex 66 positioned lowest in the float 63, the decrease rate of buoyancy acting on the float 63 is bigger when an upper portion of the float 63 comes out of the surface of ink than when a lower portion of the float 63 comes out of the surface of ink. Therefore, once the first side 65 comes out of the surface of ink, the buoyancy acting on the float 63 drastically decreases, and it becomes easier for the pivotable member 60 to move.

According to the embodiment as described above, the float 63 has a triangular pole shape, and when the pivotable member 60 is in the first position and when viewed in the axial direction of the support shaft 64, i.e., in the width direction 51, the float 63 has a triangular shape having the first side 65 positioned above the vertex 66. Therefore, when the float 63 comes out of the surface of ink, the float 63 readily moves down and the pivotable member 60 pivots accordingly. Even when bubbles and/or a film of ink are formed between the detection portion 62 and the inner wall surfaces of the pair of side walls defining the detection chamber 33 and/or between the float 63 and the inner wall surfaces of the pair of side walls 37, 38, which increases resistance to the movement of the pivotable member 60, the pivotable member 60 moves smoothly based on the amount of ink stored in the ink chamber 36. The accuracy in the determination as to whether the ink chamber 36 has the predetermined amount or more of ink stored therein is high.

Because the vertex 66 is positioned lowest in the float 63, ink may not be caught between the float 63 and the lower surface of the ink chamber 36 after the pivotable member 60 pivots. Therefore, ink can be consumed efficiently. On the contrary, if the float 63 did not have the vertex 66 and had a flat bottom surface, more ink might be caught between the float 63 and the lower surface of the ink chamber 36 after the pivotable member 60 pivots.

In the embodiment described above, the second side 69 and the third side 70 form a right angle therebetween. In another embodiment, the second side 69 and the third side 70 may form an obtuse angle. In the embodiment described above, the vertex 66 between the second side 69 and the third side 70 is rounded, the vertex 67 between the first side 65 and the second side 69 is rounded, and the vertex 68 between the first side 65 and the third side 70 is rounded. In another embodiment, the vertex 66 may be pointed, the vertex 67 may be pointed, and the vertex 68 may be pointed. In the embodiment described above, the support shaft 64 is inserted through the opening of the pivotable member 60. In another embodiment, the pivotable member 60 may comprise a support shaft extending from the arm body 61 in both opposite directions in the width direction 51. In the embodiment described above, the float 63 has a triangular pole shape. In another embodiment, the float 63 may have a circular cone shape. In the embodiment described above, the detection portion 62 is configured to be detected by the optical sensor 114. In another embodiment, the pivotable member 60 may not comprise the detection portion 62, and the float may be configured to be detected by an optical sensor 114.

While the invention has been described in connection with various example structures and illustrative embodiments, it will be understood by those skilled in the art that other variations and modifications of the structures and embodiments described above may be made without departing from the scope of the invention. Other structures and embodiments will be understood by those skilled in the art from a consideration of the specification or practice of the invention disclosed herein. It is intended that the specification and the described examples are merely illustrative and that the scope of the invention is defined by the following claims.

The invention claimed is:

1. An ink cartridge comprising:

an ink chamber configured to store ink therein;

a shaft positioned in the ink chamber;

a pivotable member comprising a float; and a first contact portion positioned below the shaft in the ink chamber, wherein the float is configured to move based on an amount of ink stored in the ink chamber, and the pivotable member is configured to move about the shaft between a first position and a second position when the float moves, wherein the float is positioned higher when the pivotable member is in the first position than when the pivotable member is in the second position, wherein the float has a triangular shape when viewed in an axial direction of the shaft, and the triangular shape comprises a first side having a first dimension, a second side having a second dimension, and a third side having a third dimension, wherein the first dimension is greater than each of the second dimension and the third dimension, wherein the first side is positioned above a vertex between the second side and the third side when the pivotable member is in the first position, wherein, when the ink cartridge is in use and the pivotable member is in the first position, the first side extends in parallel with a surface of ink stored in the ink chamber, wherein the pivotable member further comprises a second contact portion, and wherein contact between the first contact portion and the second contact portion keeps the first side extending in parallel with the surface of ink when the ink cartridge is in use and the pivotable member is in the first position.

2. The ink cartridge of claim 1, wherein the pivotable member further comprises a detection portion, wherein the shaft is positioned between the detection portion and the float, and the detection portion is positioned higher when the pivotable member is in the second position than when the pivotable member is in the first position.

3. The ink cartridge of claim 2, further comprising a detection chamber, wherein the detection chamber is in fluid communication with the ink chamber, and the detection portion is positioned in the detection chamber.

4. The ink cartridge of claim 1, wherein the second side and the third side form a right angle therebetween.

5. The ink cartridge of claim 1, wherein a vertex between the first side and the second side is positioned adjacent to the shaft.

6. The ink cartridge of claim 1, wherein contact between the first contact portion and the second contact portion prevents the pivotable member from pivoting beyond the first position in a direction that the float moves upward.

7. The ink cartridge of claim 1, wherein a vertex between the first side and the second side is rounded, and a vertex between the first side and the third side is rounded.

8. The ink cartridge of claim 7, wherein the vertex between the second side and the third side is rounded.

9. The ink cartridge of claim 1, wherein the second dimension is equal to the third dimension.

10. The ink cartridge of claim 1, wherein when the pivotable member is in the first position, the first side extends in a first direction intersecting a gravitational direction, the second side extends in a second direction intersecting the gravitational direction, and the third side extends in a third direction intersecting the gravitation direction.

* * * * *